US008025506B2

(12) United States Patent
Cairns

(10) Patent No.: US 8,025,506 B2
(45) Date of Patent: Sep. 27, 2011

(54) HARSH ENVIRONMENT ROTARY JOINT ELECTRICAL CONNECTOR

(75) Inventor: James L. Cairns, Ormond Beach, FL (US)

(73) Assignee: Teledyne ODI, Inc., Daytona Beach, FL (US)

( * ) Notice: Subject to any disclaimer, the term of this patent is extended or adjusted under 35 U.S.C. 154(b) by 0 days.

(21) Appl. No.: 13/009,681

(22) Filed: Jan. 19, 2011

(65) Prior Publication Data

US 2011/0177697 A1 Jul. 21, 2011

Related U.S. Application Data

(60) Provisional application No. 61/296,604, filed on Jan. 20, 2010.

(51) Int. Cl.
*H01R 39/00* (2006.01)

(52) U.S. Cl. ..... 439/24; 439/201

(58) Field of Classification Search ..... 439/13, 439/18, 201

See application file for complete search history.

(56) References Cited

U.S. PATENT DOCUMENTS 3,508,188 A * 4/1970 Buck ..... 439/141
3,643,207 A 2/1972 Cairns
3,729,699 A * 4/1973 Briggs et al. ..... 439/140
4,390,229 A * 6/1983 Chevalier ..... 439/201
4,606,603 A 8/1986 Cairns
4,948,377 A 8/1990 Cairns
5,171,158 A 12/1992 Cairns
5,334,032 A * 8/1994 Myers et al. ..... 439/140
5,484,296 A * 1/1996 Taylor ..... 439/140
6,017,227 A * 1/2000 Cairns et al. ..... 439/138

OTHER PUBLICATIONS

U.S. Appl. No. 13/103,698, filed Feb. 18, 2011.
U.S. Appl. No. 12/943,301, filed Nov. 10, 2011.

* cited by examiner

*Primary Examiner* — Tulsidas C Patel
*Assistant Examiner* — Harshad Patel
(74) *Attorney, Agent, or Firm* — Procopio, Cory, Hargreaves & Savitch LLP

(57) ABSTRACT

A rotary joint connector has a plug having a plug contact module and a mating receptacle having a receptacle contact module designed for mating engagement with the plug contact module when the connector is fully mated. One of the units has front and rear shells which are rotatably coupled together and contain the contact module which is held in the rear shell so that the rear shell and contact module are free to rotate in the front shell. The mating contact arrangement is such that the plug and receptacle contact modules do not have to be rotationally aligned to maintain electrical contact, so that relative rotation of the electrical contacts of the two contact modules about the mating axis as a result of rotation of the rear shell does not degrade the quality of the connected circuits.

35 Claims, 9 Drawing Sheets

HARSH ENVIRONMENT ROTARY JOINT ELECTRICAL CONNECTOR

BACKGROUND

1. Related Application

The present application claims the benefit of co-pending U.S. provisional pat. App. Ser. No. 61/296,604, filed Jan. 20, 2010, the contents of which are incorporated herein by reference in their entirety.

2. Field of the Invention

The present invention relates generally to connectors which can be mated and unmated in very harsh environments, such as underwater, and is particularly concerned with a harsh environment electrical connector.

3. Related Art

There are many known electrical rotary joint connectors which function in dry environments, but not many that are suitable for harsh or underwater environments. Harsh environment rotary joint connectors are currently in use only for limited applications, such as down-hole drill strings, but they are not intended for general use, or for mating while completely submerged in a hostile environment.

Most current underwater connectors designed for mating while completely submerged need to have the plug and receptacle contact parts keyed into rotational alignment for mating. The earliest underwater connector was a rubber-bodied pin-and-socket connector that embodied one or more ring-like contacts molded into a cylindrical rubber pin, and respective one-or-more ring-like contacts molded into a rubber bore, which required no particular rotational alignment. For that reason, such connectors are said to be keyless. Although inexpensive, such connectors are not reliable enough for most critical applications. They have the distinct disadvantage that they cannot be unmated underwater except at very modest depths; and, in models having more than one set of contacts arranged along the pin and bore, cross-connection briefly takes place as un-matched pin and socket contacts slide past each other during mating and de-mating. Cross-connecting circuits can sometimes be disastrous for the electronics to which they are attached.

The offshore oil and gas industry is one of the principal markets for underwater mateable connectors. Many of the connectors used for that industry's subsea operations are connected and disconnected remotely, either by being mounted to large, opposed plates (stab plates) that come together during the mating process to join arrays of connectors, hydraulic couplers, and the like, or by the manipulators of remotely operated vehicles (ROV's). Mating remotely is made more difficult and expensive by the requirement to control the rotational alignment of the individual components to be mated.

Two-contact fluid-filled electrical connectors that required no rotational alignment were made commercially available in the early 1980s. One example of such a connector is described in U.S. Pat. No. 4,606,603 of Cairns. These connectors did solve the rotational alignment problem, but one problem with such connectors was that two contacts were not enough to satisfy the needs of most operations. Another problem was that the receptacle's circular end-opening, which had to be pinched tightly closed before and after mating, had to be stretched several hundred percent to receive the plug's pin. If mated for a long time, particularly at low ocean temperatures, the opening did not close upon de-mating, and the connector subsequently failed.

In the late 1980's, multiple pin, fluid-filled connectors were once again introduced. They have all the required barriers, are robust, and exceptionally reliable. One such connector is the subject of U.S. Pat. No. 4,948,377 of Cairns. These connectors are manufactured by Teledyne ODI of Daytona Beach, Fla. They replaced the two-contact, single pin fluid-filled connectors described above as the high-reliability standard for the offshore industry. These connectors still have the rotational alignment problem, however, which somewhat limits their use, and requires special keying provisions for rotational alignment.

In the early 1990's a keyless, coaxial, oil-filled, wet-mateable connector was introduced that required no rotational alignment. This connector is described in U.S. Pat. No. 5,171,158 of Cairns (hereinafter '158 patent). It consisted of multiple ring-like contacts spaced along a constant diameter portion of the plug pin. The receptacle had corresponding ring-like contacts spaced along a rubber bore to receive the plug contacts. The overall layout of the contacts was very similar to the first type of connector described above. The main differences were that the connector of the '158 patent housed the receptacle contacts in a pressure-balanced, fluid-filled chamber; and, when mated, the individual pin/socket pairs were separated from each other by a single rubber seal. Unlike the coaxial connector of U.S. Pat. No. 4,606,603 (hereinafter '603 patent), the anterior sealed opening through which the plug's probe passed when entering the receptacle's chamber was occupied by a spring loaded piston before and after mating. That removed the necessity of the sealed opening to be pinched closed to a zero diameter as in the '603 patent.

The connector shown in the '158 patent was reasonably successful technically and quickly gained a dedicated customer base, but it was discontinued after being on the market for just a couple of years. It proved to be too expensive and difficult to manufacture. It also still had the problem of cross-connection during mating and de-mating as the plug's contacts wiped across receptacle contacts which were not their intended counterparts.

Thus, underwater connectors today typically require rotational alignment or keying for connection underwater. Such connectors cannot be used to connect pieces of equipment that rotate relative to one another, such as slip rings, and cannot compensate for problems of cable twisting during and after mating.

SUMMARY

Embodiments described herein provide a new harsh environment rotary joint connector suitable for electrical applications.

In one embodiment, a submersible or harsh environment connector is provided which comprises a plug unit having a plug contact module having a pin with an outer surface carrying a plurality of axially spaced, annular contacts of gradually decreasing diameter towards a forward end of the pin, a receptacle unit releasably securable to the plug unit and having a fluid-filled chamber containing a receptacle contact module which has a corresponding number of axially spaced, annular contacts of gradually increasing diameter towards a forward end of the receptacle unit, with a sealing mechanism at a forward end of the chamber which seals the chamber when the units are unmated and forms a seal with the plug unit probe or pin both during and after mating of the units. In one embodiment, one of the units has first and second relatively rotatable front and rear shells, and the associated contact module is secured to one of the shells, thereby providing a rotary joint.

In one embodiment, the sealing mechanism may comprising a spring-loaded stopper which is biased into an opening in the forward end of the receptacle chamber surrounded by an annular front seal member which seals against the stopper in the unmated condition. As the plug pin enters the chamber, it pushes the stopper back and the front seal member seals against the outer surface of the pin.

In another embodiment, the plug pin is hollow, and the forward end of the receptacle unit comprises an annular end seal. A center rod extends through the chamber and has a forward end portion having an outer seal which is in sealing engagement with the annular end seal in the forward end of the chamber in the unmated condition. When the hollow plug pin enters the receptacle unit, it presses against the interface between the two seals, eventually passing between the seals and into the chamber. In the mated condition, the annular end seal and opposing outer seal on the forward end of the center rod seal against opposing outer and inner faces of the hollow plug pin.

In one embodiment of the rotary joint, the plug unit has a rear shell and a front shell, and the rear shell is free to rotate within the front shell via a slip-ring joint. The plug pin or contact module is held within the rear shell so as to rotate with the rear shell. Due to the keyless or rotation-independent design of the mating plug and receptacle contacts, the plug and receptacle modules can rotate relative to one another about the mating axis of the units without degradation of the quality of the mating circuits. In practice, the rear shell of the plug unit is attached to a cable termination, and the rear shell and plug contact module or pin rotate relative to the remainder of the connector to accommodate any torque or twist on the attached cable.

This arrangement overcomes some problems of previous designs since it does not require rotational alignment, and provides a multi-circuit electrical rotary joint connector usable in many harsh environment and underwater environments. The connector is not fundamentally limited in the number or size of the electrical contacts, does not require un-acceptable stretch of the elastomers, and is virtually interchangeable with the present industry-standard connectors. The connector is extremely simple and does not require complex manufacturing technology.

Although a keyless electrical connector is described above, it may form part of a hybrid electro-optical connector in other embodiments.

Potential fields of application for this rotary joint technology include underwater cable winches, moored or tethered system cables, towed-system cables, drill string connections, ROV vehicle umbilicals, seafloor cable pay-out packs, and other uses not yet envisioned.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a harsh environment electrical rotary joint connector for simultaneously joining two or more electrical circuits. The connector has mateable plug and receptacle units each containing a contact module, with the plug contact module comprising a pin or probe which enters a contact chamber in the receptacle shell on mating. The pin has a plurality of annular contacts in progressively larger diameters in a direction away from the tip of the pin, while the receptacle portion has annular contacts staged in matching, progressively smaller diameters from the entry end of the receptacle unit, so that the plug and receptacle module can rotate relative to one another after mating while maintaining engagement between the respective contacts. One of the units has relatively rotatable front and rear shells with the respective contact module secured to one of the shells to provide a rotary joint connection when the units are mated.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

FIGS. 1 to 10 illustrate one embodiment of a multi-circuit, rotary joint electrical connector 500 that can be mated and demated in very harsh environments, such as at depth in seawater. The connector 500 comprises releasably mateable connector units comprising a plug unit 200 which is illustrated in detail in FIGS. 6 to 9, and a receptacle unit 300 illustrated in detail in FIGS. 4 and 5. The connector is shown in a mated condition in FIGS. 1 and 10, and FIGS. 2 and 3 illustrate the separate plug and receptacle shells positioned in axial alignment prior to mating.

The plug and receptacle contact modules are designed for keyless engagement. In other words, no particular rotational alignment is required between the plug and receptacle modules during or after mating in order to ensure that the plug and receptacle contacts are properly engaged when the units are mated. Any keyless plug and receptacle contact modules may be used in this connector. In the illustrated embodiment, the connector is a keyless electrical connector similar to that described in co-pending application Ser. No. 12/943,301 filed on Nov. 11, 2010, which claims priority from provisional application No. 61/260,100 filed on Nov. 11, 2009, and the contents of co-pending application Ser. No. 12/943,301 are incorporated herein by reference. In the illustrated embodiment, the connector of the prior application is modified to incorporate the rotating joint structure, as described in more detail below.

Figure 4:
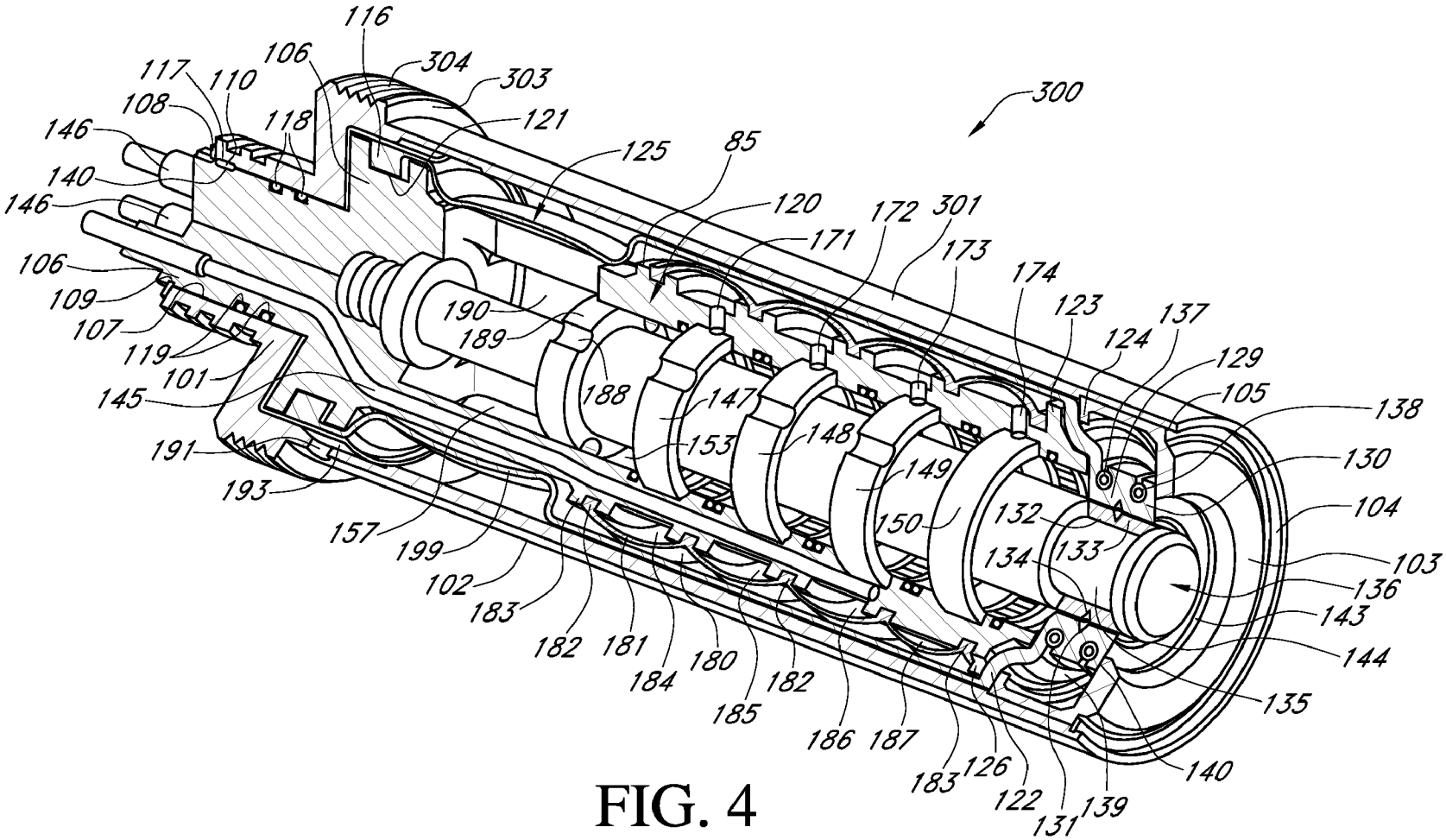
FIG. 4 is a 135 degree axial, partial cross-sectional view of the receptacle unit of FIGS. 1 to 3.
Figure 5:
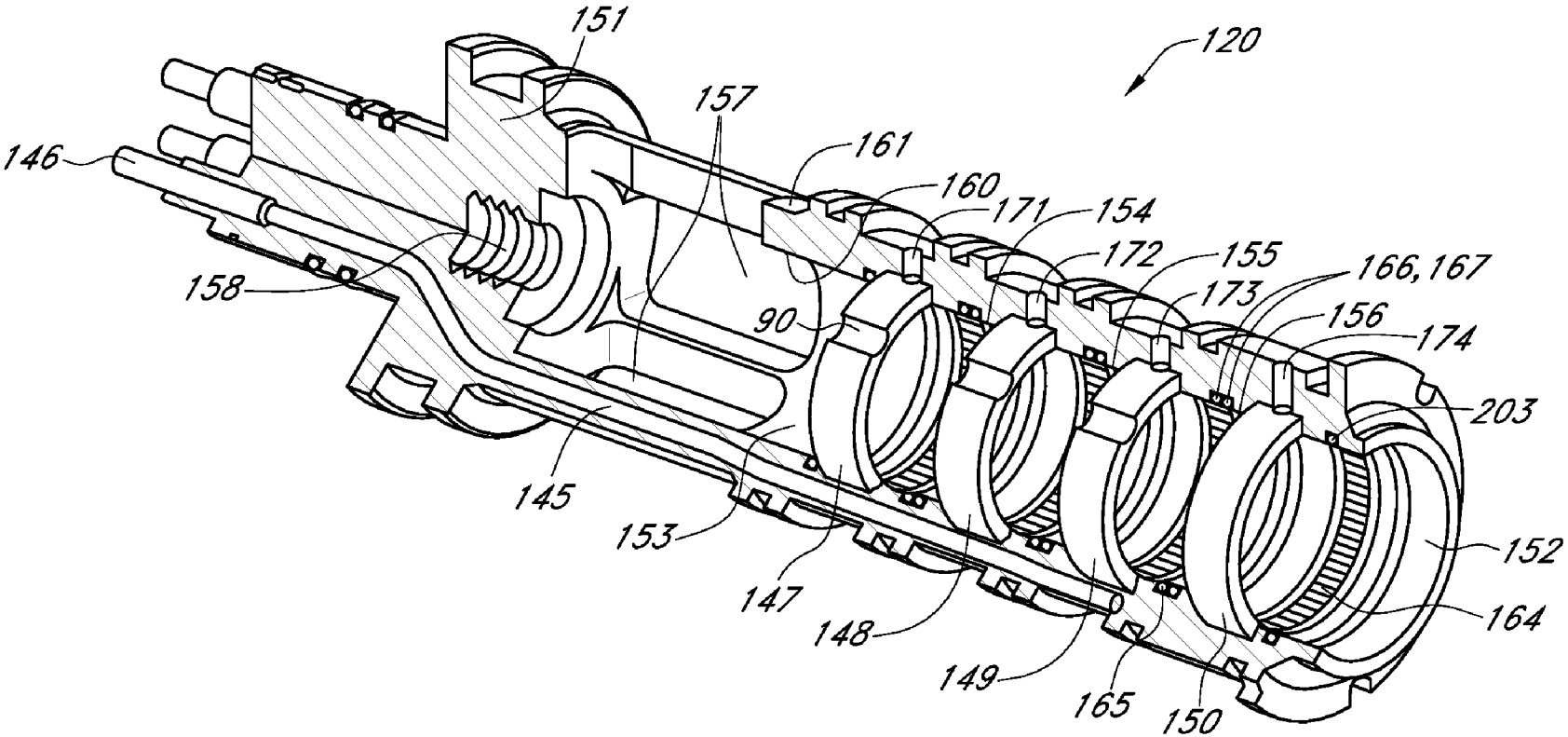
FIG. 5 is a 135 degree axial, partial cross-sectional view of the receptacle contact module of the receptacle unit of FIG. 4.
Figure 6:
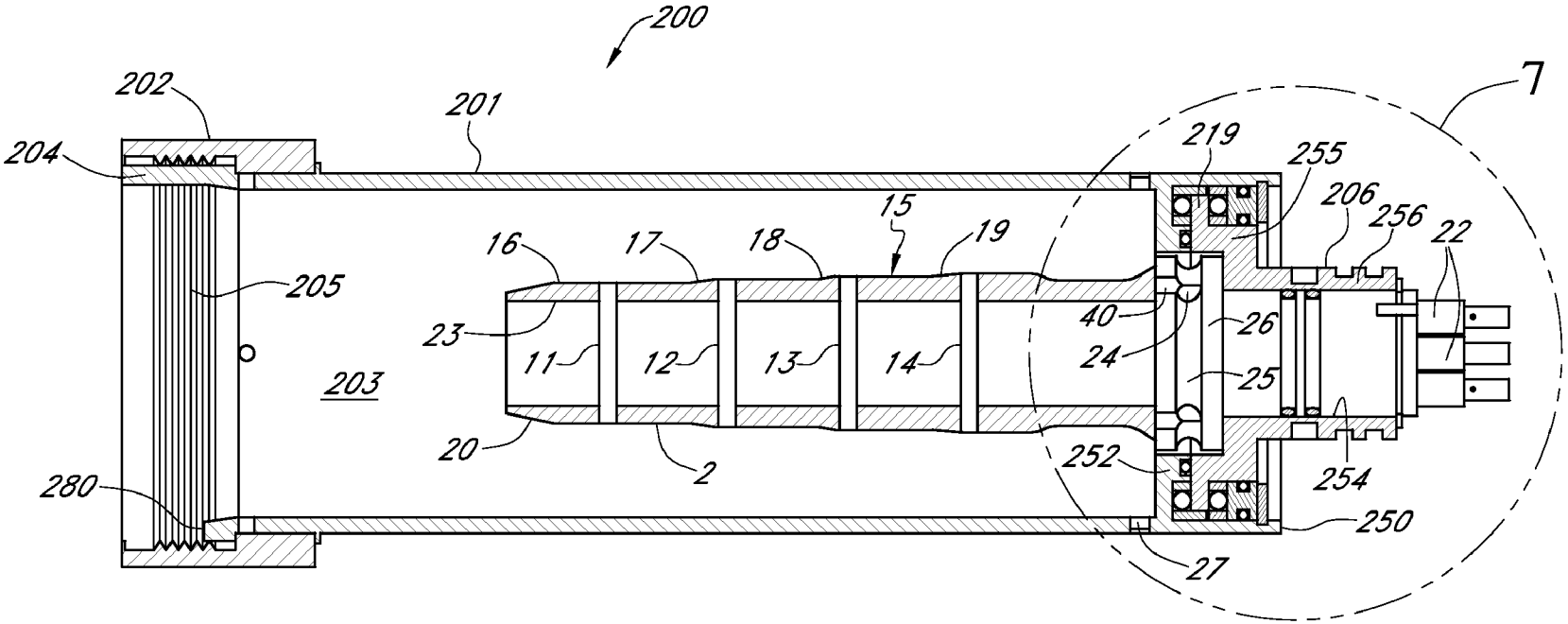
FIG. 6 is a longitudinal cross sectional view of the plug unit of the connector of FIGS. 1 to 3.

As in co-pending application Ser. No. 12/943,301 referenced above, the connector 500 is a pin-and-socket connector having first and second mateable connector units 200, 300. In the illustrated embodiment, the first connector unit comprises a plug unit containing a plug contact module 2 which has a hollow pin 15 with annular contacts staged in progressively larger diameters along the pin from tip to base, as illustrated in FIG. 6. The second connector unit is a receptacle unit having a contact module with respective annular contacts staged in progressively smaller diameters inward from the mating face along an internal bore, as illustrated in FIGS. 4 and 5 and described in more detail below. When the units are mated, as in FIG. 10, the plug pin enters the internal bore of the receptacle module and moves into mating engagement with the receptacle module. In the fully mated condition, each annular contact on the plug pin engages a corresponding annular contact or contact seat in the receptacle module, and the contacts remain in engagement regardless of any relative rotation between the plug and receptacle modules.

The only difference between the receptacle unit 300 of this embodiment and the receptacle unit described in co-pending application Ser. No. 12/943,301 referenced above is the threaded rear end portion or coupling portion 304 with shoulder 303 and alignment slot 302. All other parts of the receptacle unit are identical to those described in the referenced co-pending application.

Figure 3:
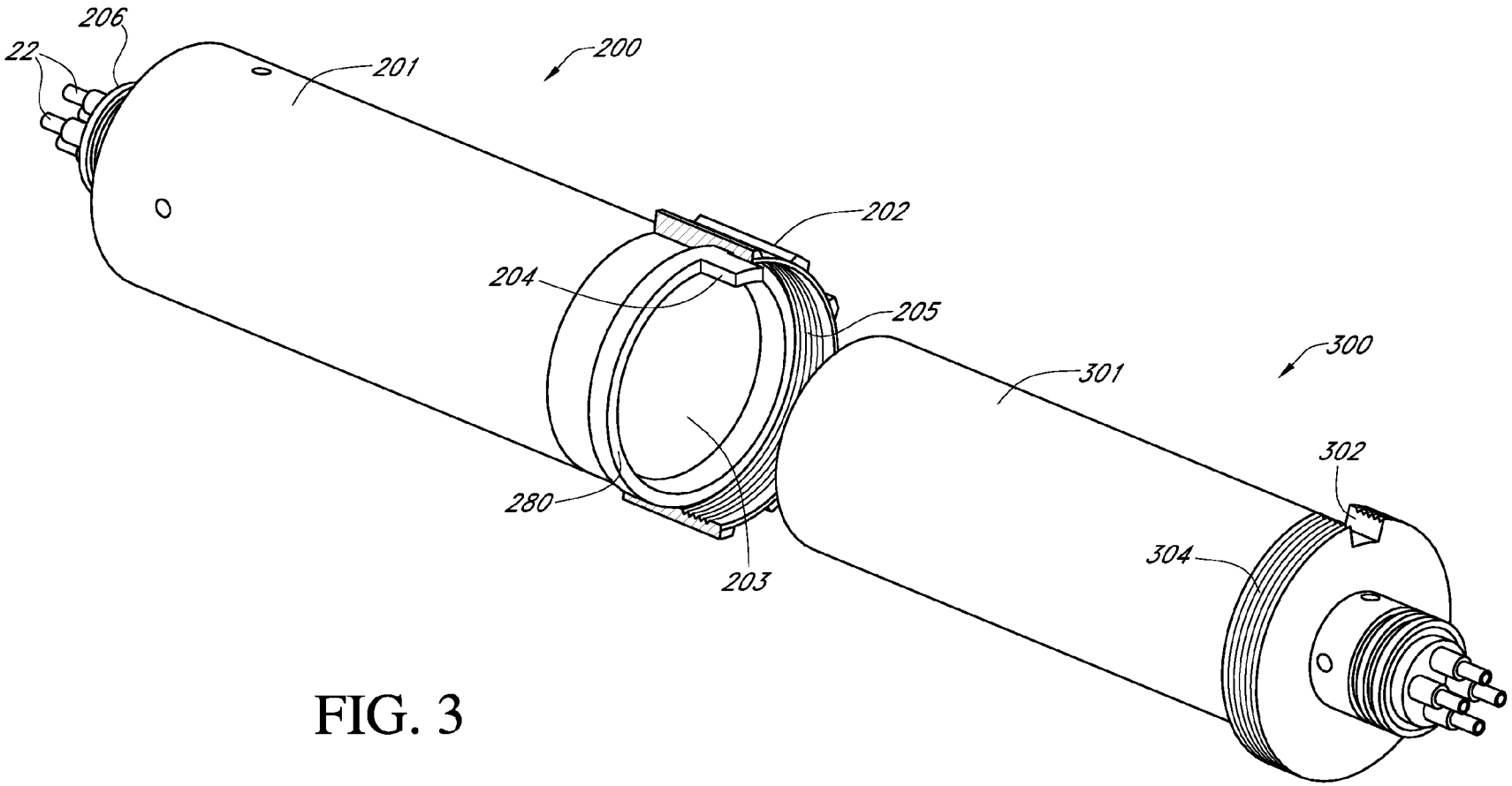
FIG. 3 is a view of the units of FIG. 2 in a different orientation with the plug coupling nut broken away in axial half-section to reveal the keying mechanism.

Changes to plug unit 200 are more extensive. As compared to the plug shell shown in the application referenced above, the plug shell of this embodiment comprises two parts: rear shell 206 and front shell 201. Plug front shell 201 has a bore 203 and is open at its forward and rear ends 280, 250, with an annular, inwardly projecting flange or shoulder 252 spaced inwardly from the rear end. Rear shell 206 has a through bore 254, and is rotatably connected to front shell 201 via a rotary joint which is described in more detail below in connection with FIG. 7. Rear shell 206 has a stepped outer diameter, and with an enlarged outer annular flange 219 at its forward end, a seating portion 255 of reduced diameter extending from flange 219, and a rear end portion 256 of diameter less than that of portion 255 extending rearwards from portion 255 out of the rear end of the front shell. Plug contact module or pin 2 has a base or rear end portion 257 extending through the bore 254 in rear shell 206 and a contact pin or probe 15 extending forwards from rear shell 206 within the bore in front shell 201, terminating short of the forward end of front shell 201. A coupling nut 202 with internal threads 205 is rotatably mounted at the forward end of shell 201 so as to project forward from the front end 280 of the plug shell. As illustrated in FIG. 3, a key member or tongue 204 projects forward from the front end of plug shell 201 into the projecting portion of coupling nut 202. Solder pots or cable lead connectors 22 are provided at the rear end of plug contact module 2.

Figure 7:
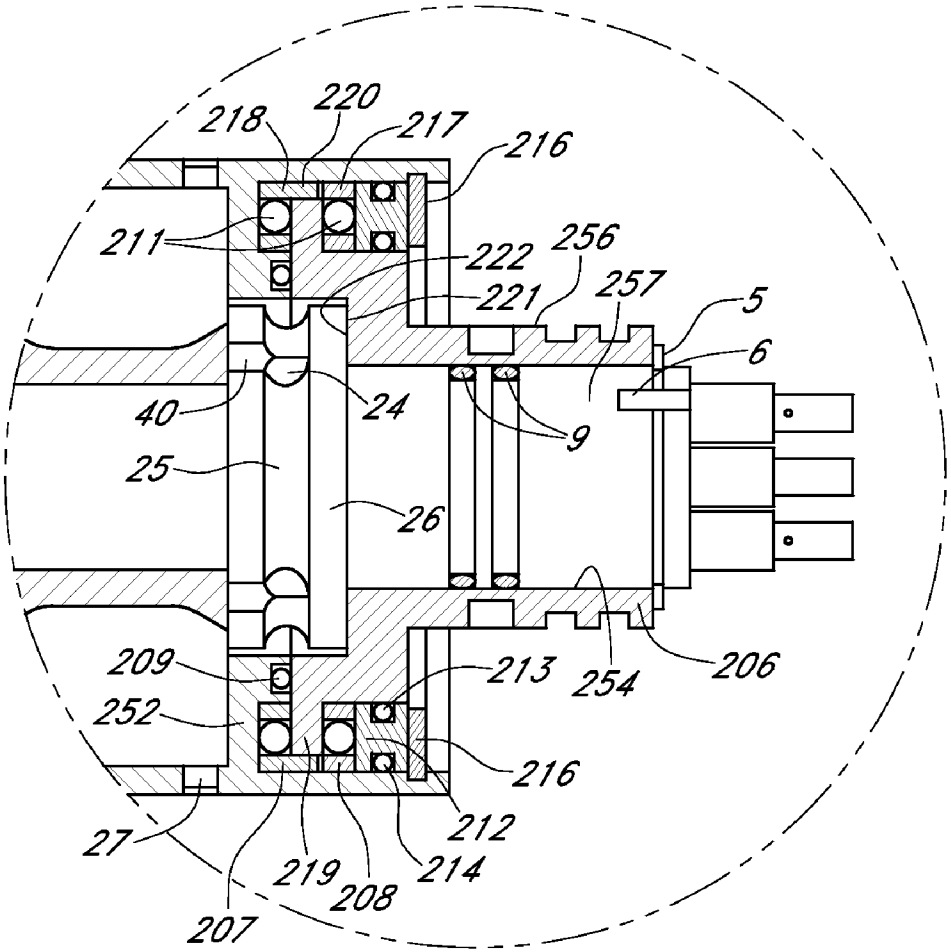
FIG. 7 is an enlarged sectional view of the circled rear portion of the plug unit of FIG. 6, illustrating the rotary joint.

Plug contact module 2 is axially held in place within rear shell 206 by base flange 26 which has an end face 222 which engages internal step or shoulder 221 of rear shell, and retainer ring 5 mounted adjacent the rear end of base 257 and engaging the rear end of rear shell 206, as best illustrated in FIG. 7. Plug contact module 2 is rotationally held in place in the rear shell by alignment pin 6. O-rings 9 seal the interface 8 between plug contact module 2 and rear shell 206.

Rear shell 206 is rotationally mounted in front shell 201 by a pair of thrust bearing assemblies 207,208. As illustrated in FIG. 7, the enlarged forward end flange 219 of rear shell 206 is rotatably mounted between inner shoulder or flange 252 of front shell 201 and back up ring 212, which together form an annular seating groove or chamber which receives flange 219. This chamber is sealed via a first annular o-ring seal 209 between front shell shoulder 252 and the opposing end face of rear shell 206, and inner and outer seals 213, 214 on back up ring 212. Inner seal 213 is located between the inner face of back up ring 212 and the outer surface of rear shell 206 and outer seal 214 is located between the outer face of back up ring 212 and the inner surface of front shell 201, respectively.

Figure 9:
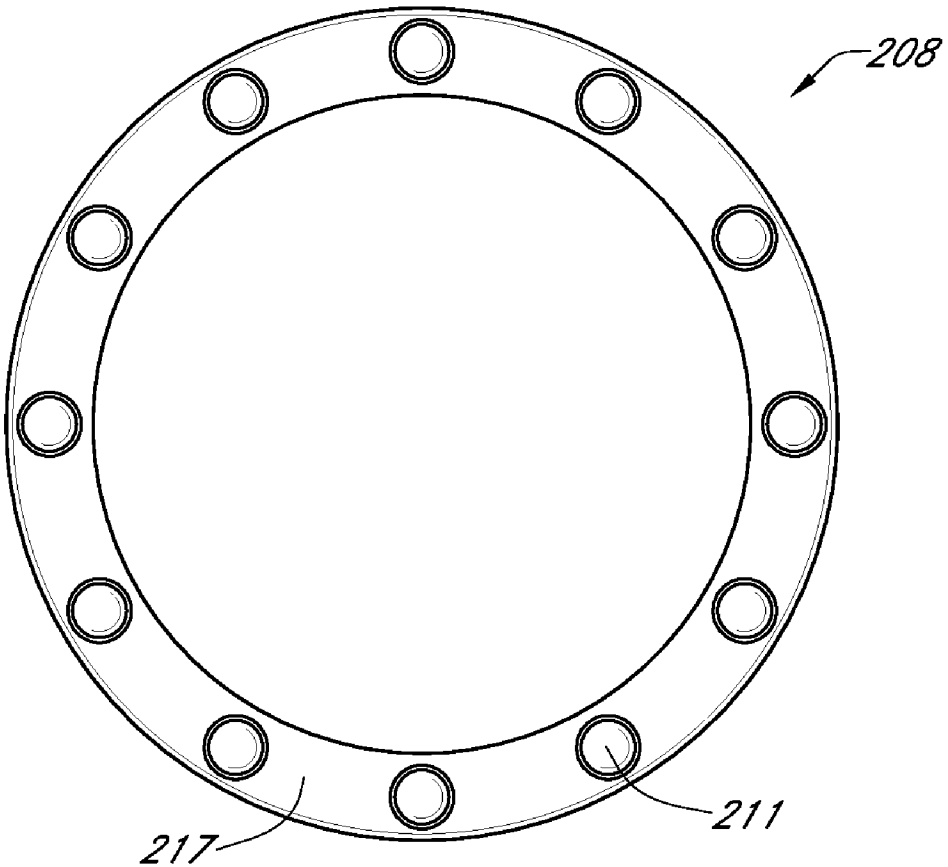
FIG. 9 is a side lavational view of the bearing assembly of FIG. 8.
Figure 8:
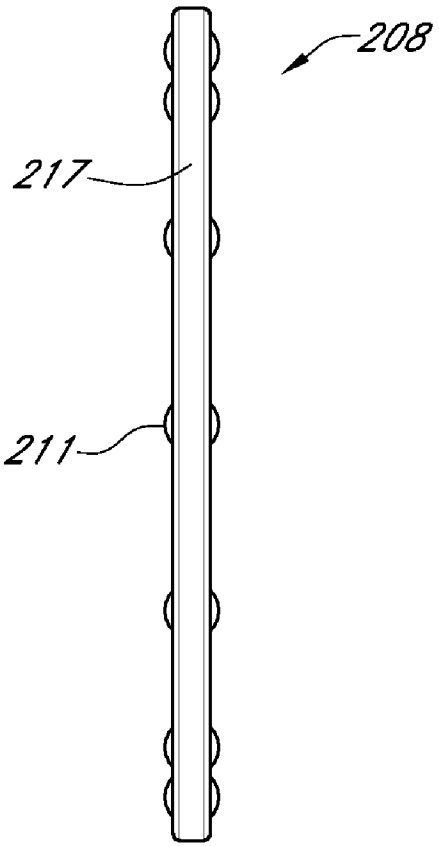
FIG. 8 is a front lavational view of a bearing assembly forming part of the rotary joint.

FIG. 8 illustrates bearing assembly 208 in front view, showing bearings 211 arranged radially in bearing race 217. FIG. 9 is a side view of bearing assembly 208 demonstrating bearings 211 protruding from either side of bearing race 217. Bearing assembly 207 is identical to bearing assembly 208 except for annular lip 220 of bearing assembly 207 which extends over flange 219 and keeps flange 219 axially centered within front shell 201. Bearings 211 of bearing assembly 207 are axially captured between opposing surfaces of shoulder 252 of front shell 201 and flange 219. Bearings 211 of bearing assembly 208 are axially captured between opposing faces of flange 219 and back-up ring 212. Back-up ring 212 is axially retained in place within front shell 201 by retainer ring 216.

In actual use, it is expected that rear shell 206 would be mechanically attached to a cable termination (not shown) that would pass cable thrust, tension, bending, and torque from the cable to said rear shell, without applying significant forces directly to plug contact module 2. Cable thrust and tension passes from the mechanical termination to flange 219 of rear shell 206 and from there to front shell 201 through bearings 211 acting against the opposing surface of shoulder 252 of the front shell in the case of thrust, and against the opposing surface of back-up ring 212 in the case of tension. Bending loads are passed through the bearings 211 of both bearing assemblies 207, 208.

Careful study of plug assembly 200 reveals that the sub-assembly consisting mainly of plug contact module 2 and rear shell 206 is free to rotate within front shell 201, even while supporting tensile, thrust, bending, and torque forces.

Seals 209, 213, and 214 cooperate with the surfaces against which they seat to form a closed chamber (not numbered) housing bearing races 207, 208, and the outer portion of flange 219. This chamber may be packed full of a packing material such as a grease or gel (not shown) as part of the assembly process. Seals 209, 213, and 214 are free to slide laterally in their grooves thereby slightly expanding or contracting the chamber volume which they help define, such volumetric changes compensating for small variations of the enclosed grease or gel volume as would occur due to pressure and temperature changes.

In one embodiment of the device, bearings 211 are of a non-metallic material, such as ceramic, and furthermore bearing races 207, 208 are of a composite high-strength plastic material. These choices reduce the probability of material degradation due to corrosion, and reduce friction and galling that might occur if all components were metal.

Plug contact module 2 includes four contacts 11, 12, 13, 14 of progressively increasing diameter in a direction away from the open front end of the front shell 201 (see FIG. 6). The contacts are integrally molded with rigid, non-electrically-conductive material into a monolithic unit comprising base 257 and forward-projecting, generally cylindrical pin 15 with a tapered tip 20. Pin 15 has an outer surface shaped into four consecutive diameter steps, each of the four steps being larger than its predecessor. Contact bands 11, 12, 13, 14 coincide with the respective steps, as illustrated in FIG. 6. Plug pin 15 is hollow along at least the majority of its length from the forward tip 20 and has an internal bore 23. A greater or lesser number of diameter steps and associated contact bands may be provided in alternative embodiments, depending on the number of circuits to be connected.

Respective conductors (not visible in the drawing) extend from each ring-like contact to typical solder cup 22 on the contact module's cable-termination end. Contacts 11, 12, 13, 14 form integral units with the conductors and respective solder cups 22 within the molded contact assembly. Notches on the inner diameters of contacts 11, 12, 13, 14 permit clearance between the contacts and conductor portions 21 of neighboring contacts, the clearance being filled with dielectric material during the over-molding process. Prior to over-molding, the conductors are coated with a very thin, resilient, non-electrically-conductive material (not shown). In the post-mold shrinkage the over-molded material squeezes tightly around the thin resilient coating, thereby forming a hermetic seal to the conductors.

Bore 23 extends inward from the anterior end of plug contact module 2 to a point near the base or rear end portion 257 of module 2. Radial passages 24 ventilate bore 23 to groove 25 that runs around the circumference of base flange 26. Ports 27 in plug shell 201 vent groove 25 to the outside environment.

Figure 2:
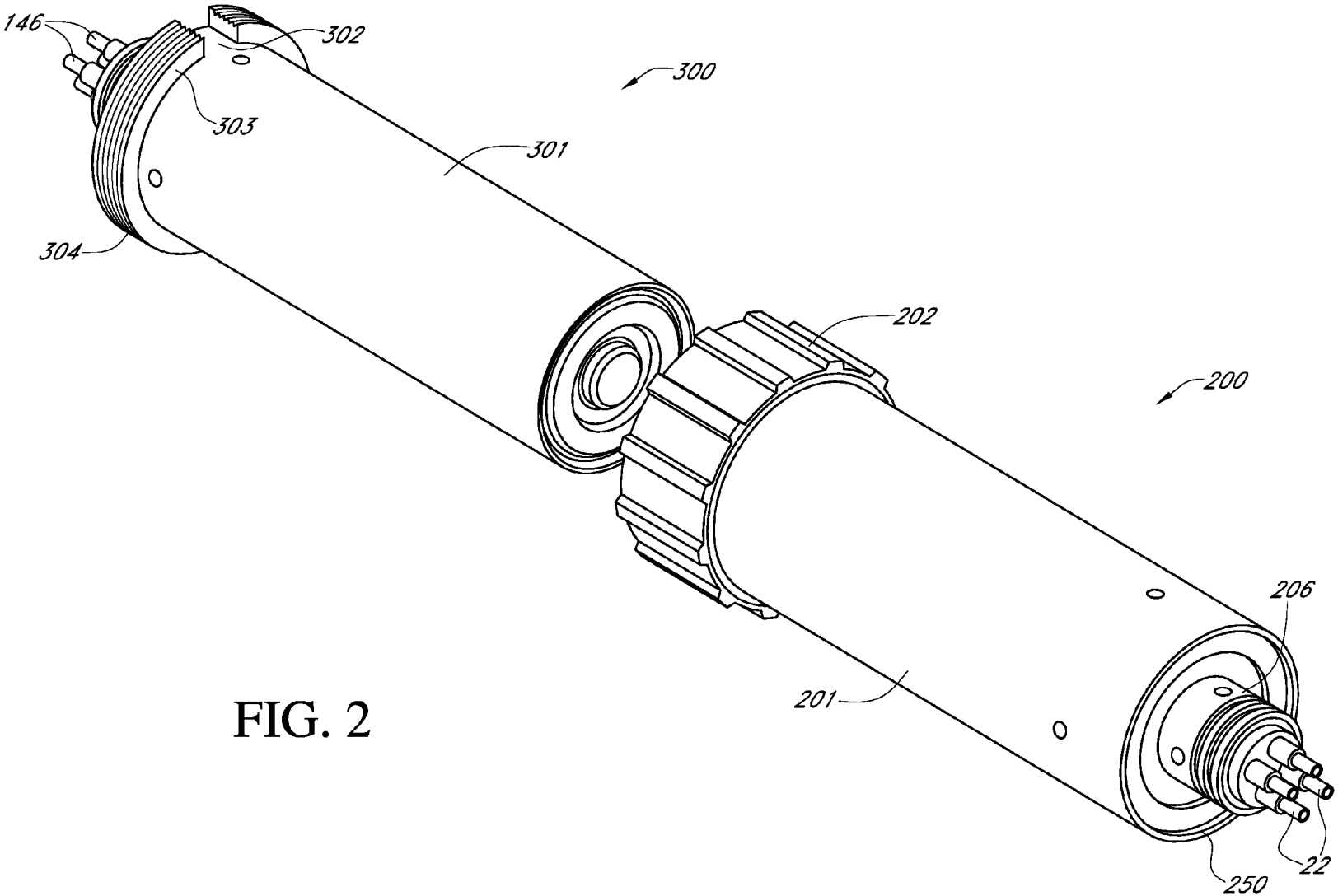
FIG. 2 is a perspective view of the connector of FIG. 1 with the plug and receptacle units separate from one another in an unmated condition.

As illustrated in FIGS. 3 and 4, receptacle unit 300 has an outer shell 301 of smaller diameter than the plug front shell 201. Shell 301 has an enlarged end portion having an annular shoulder or stop face 303. External threads 304 on the end portion are designed for threaded engagement with internal threads 205 of plug coupling nut 202, as described below. As illustrated in FIGS. 2 and 3, a slot 302 is provided in the enlarged end portion for receiving tongue 204 when the units are mated, as further described below. Receptacle contact module 120 mounted in the outer shell is designed for mating engagement with plug contact module 2. Module 120 has a rear end secured in a through bore in the receptacle rear end wall and projects forward from the rear end wall into shell 301, as illustrated in FIG. 4.

FIG. 5 illustrates one embodiment of the receptacle contact module 120, while FIG. 4 illustrates the receptacle contact module incorporated in receptacle unit 300. Contact module 120 has a generally tubular anterior portion of varying radial cross-section, said tubular portion having a wall defined by inner surface 160 and outer surface 161, and includes four circuits each comprising a conductor rod 145 which extends from a typical solder cup 146 to the respective four contacts or contact seats 147, 148, 149, 150, all of which are over-molded with a rigid, non-electrically-conductive material, forming the wall of the contact module into a monolithic unit 151. Bore 152 of contact module 120 has diameter steps 153, 154, 155, 156, with the steps having diameters that are slightly larger than corresponding steps 16, 17, 18, 19 of plug pin 15. Steps 153, 154, 155, 156 house respective annular electrical contacts or contact seats 147, 148, 149, 150. Four windows 157 through the side wall of contact module 120 permit free ventilation from the inside to the outside of the wall. Threaded socket 158 in the bottom of bore 152 accepts and retains a center rod 136 which extends from the rear end to the front end of the receptacle unit. Radial passages 171, 172, 173, 174 penetrate the wall of the tubular portion of the contact module as well as penetrating contact seats 147, 148, 149, 150. The radial passages permit free ventilation from the radially inward portion of the contact seats to the exterior of contact module 120. Between each pair of electrical contacts, for instance 149,150, a seat 165 houses a pair of elastomeric seals 166,167 which, in the connector's mated condition, cooperate with plug pin 15 to seal the successive contact pairs from each other.

Receptacle contact module 120 is housed within a canister formed by receptacle shell 301, which includes a back portion 101, a front portion 102 adjacent the forward end of shell 301, and end cap 103 mounted in the open forward end of the shell. Snap ring 104 seats in groove 105 and retains end cap 103 in place. Rearward extension 106 of contact module 102 is seated in bore 107 at the back portion 101 of shell 301. Contact module 120 is arrested in axial position with respect to shell 301 by snap-ring 108 which is captured in groove 109 of rear portion 101. Retainer key 110 is captured in a bore formed by groove 117 in rearward extension 106 and a corresponding groove 140 in shell rear portion 101. O-rings 118 seated in grooves 119 of rearward extension 106 seal the interface between the contact module 120 and shell 301. Outer bladder 125 extends from the rear or base portion 101 of shell 301 to the forward open end, and has an integral sealing portion at its forward end, as described in more detail below. An elastomeric, generally tubular inner bladder 180 extends within the outer bladder from an annular shoulder 85 at a rear end portion of the receptacle module 120 up to a forward end portion of the module 120. Shoulder 116 in the posterior end of outer elastomeric bladder 125 is sealably retained in groove 121 of contact module 120.

Elastomeric inner receptacle bladder 180 is generally tubular in shape having four bulbous thin-walled sections 181 extending between heavier ribs 182. Ribs 182 are sealably stretched into respective grooves 183 formed into the exterior surface of contact module 120. The construction results in a series of small volumes 184, 185, 186, 187 whose only ventilation is respectively through passages 171, 172, 173, 174.

Center rod 136 extends from the rear end of the receptacle module through the tubular portion and up to the forward end of the receptacle shell. Center rod 136 has a large-diameter segment 189 which fits closely to inner diameter portion 153 of bore 152, serving to keep the bore and center rod axially aligned. Cutouts 188 on large-diameter segment 189 of center rod 136 permit axial ventilation across the large-diameter section. Windows 157 through the tubular wall of receptacle contact module 120 to the rear of inner bladder 180 allow free ventilation from bore 152 to the volume of oil 190 contained in outer bladder 125. The windows are large enough to permit the outer bladder to flex inward into bore 152. The extent to which a fluid-filled receptacle can compensate for volumetric changes, such as occurs when the plug pin is inserted or withdrawn, or when oil is lost during operation, depends not only on the initial volume of the oil, but also upon how much the chamber containing the oil can flex to accommodate such changes. More flex is better than less. The ability of outer bladder 125 to distort through windows 157 is therefore an important feature in extending the reliable working life of the connector.

Outer bladder 125 is ventilated to the connector's outside environment through radially-spaced passages 191 in receptacle shell 102, the passages leading to undercut portion 192 of said shell. Rigid cup-shaped guard 193 extends axially forward of said passages and serves to sealably retain shoulder 116 of outer bladder 125 into groove 121 of contact module 120. Guard 193 serves also to protect outer bladder 125 from damage due to foreign objects that might be introduced through passages 191.

A relatively heavy-walled segment 122 of the anterior portion of outer bladder 125 is held in axial position by shoulder 123 of contact module 120 acting against shoulder 124 of end cap 103. Notches 126 in shoulder 124 against which heavy-walled outer bladder segment 122 is pressed serve both to arrest rotation of outer bladder 125, and to provide fluid passage from the interior chamber of contact module 120 to the outermost portion of contact module 120 when the plug 200 and receptacle 300 portions of the connector are mated.

The extreme anterior end of outer bladder 125 terminates in heavy-walled dual elastomeric seals 129,130 which may be integrally molded features of the outer bladder and are defined as individual seals by v-groove 131. Corresponding dual end seals 132,133 secured in an annular groove or seat 135 in the forward end of center rod 136 may also be molded as a single unit and defined as individual seals by v-groove 134. Seals 132,133 act in cooperation with the opposing sealing surfaces of dual seals 129,130 to close the chamber formed by contact module 120, outer bladder 125 and center rod 136.

In the unmated receptacle unit of FIG. 4, end seals 129,130 are held tightly against corresponding end seals 132,133 by embedded garter springs 137,138 respectively. The seal-to-seal pressure therefore depends more upon the inwardly directed force provided by garter springs 137,138 than it does upon the stretch, if any, of end seals 129,130. This is major improvement over oil-filled connector receptacles that depend solely upon elastomeric stretch to accomplish the end seal. The garter springs also render the reliability of the sealed receptacle much less vulnerable to prior-art problems of seal elastic-memory loss Space 139 behind the inner surface of end cap 103 is ventilated to the outside environment by an inward radial extension 140 of space 139 between the inner surface of end cap 103 and the anterior end of end seal 130. Inward extension 140 is in communication with annular opening 143 formed between end cap 103 and end 144 of center rod 136. Comparing the position of end seals 129,130 in the unmated receptacle section of FIG. 4 to the comparable section of the mated receptacle in FIG. 10, it is seen that end seals 129,130 move radially outward into space 139 during mating to sealably accommodate plug pin 15. Environmental material (water, in the case of underwater operation) displaced by the outward radial movement of end seals 129,130 is ventilated through radial extension 140 of space 139 and annular opening 143.

Figure 1:
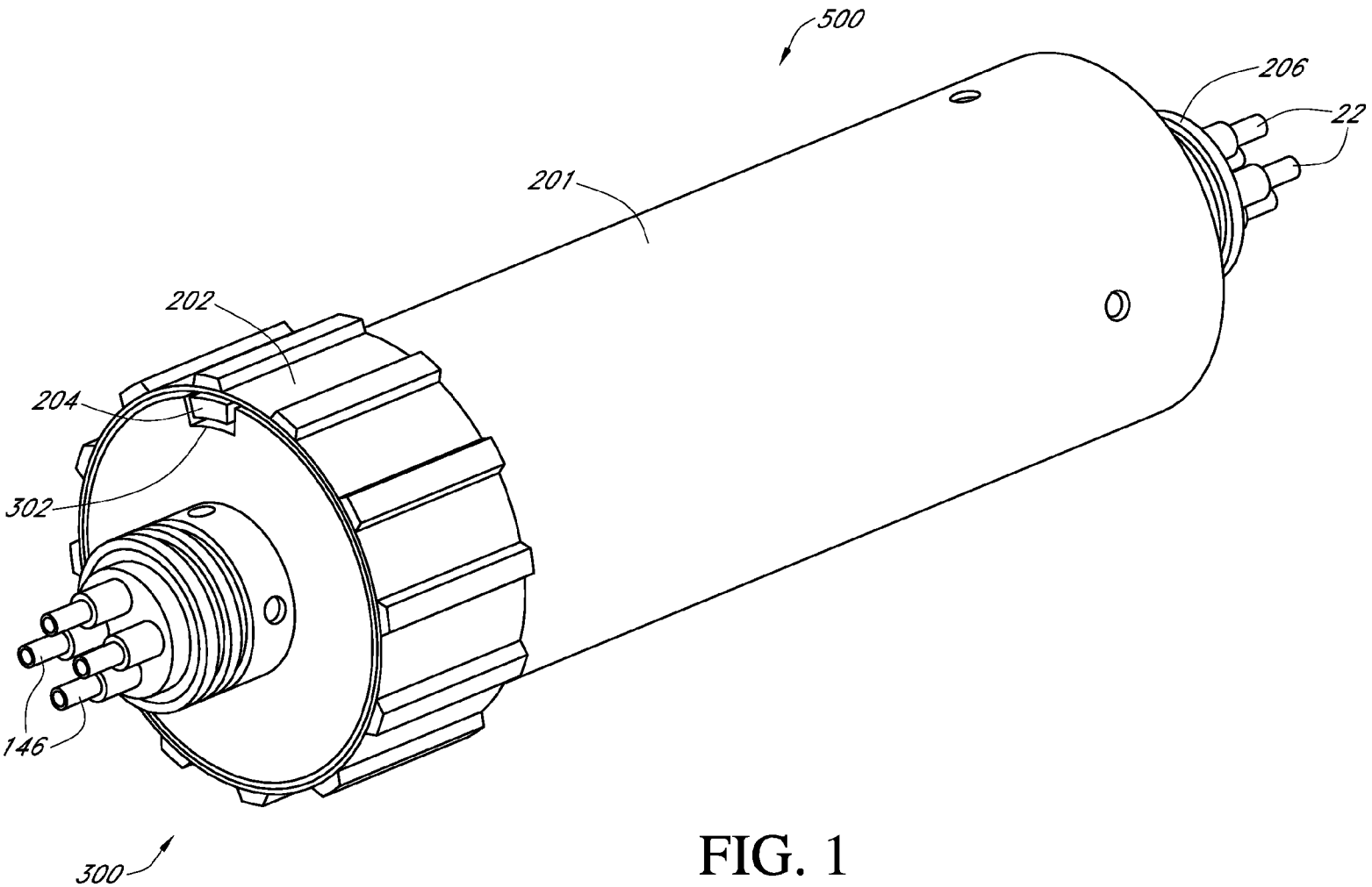
FIG. 1 is a perspective view of one embodiment of a harsh environment rotary joint connector in a mated condition.
Figure 10:
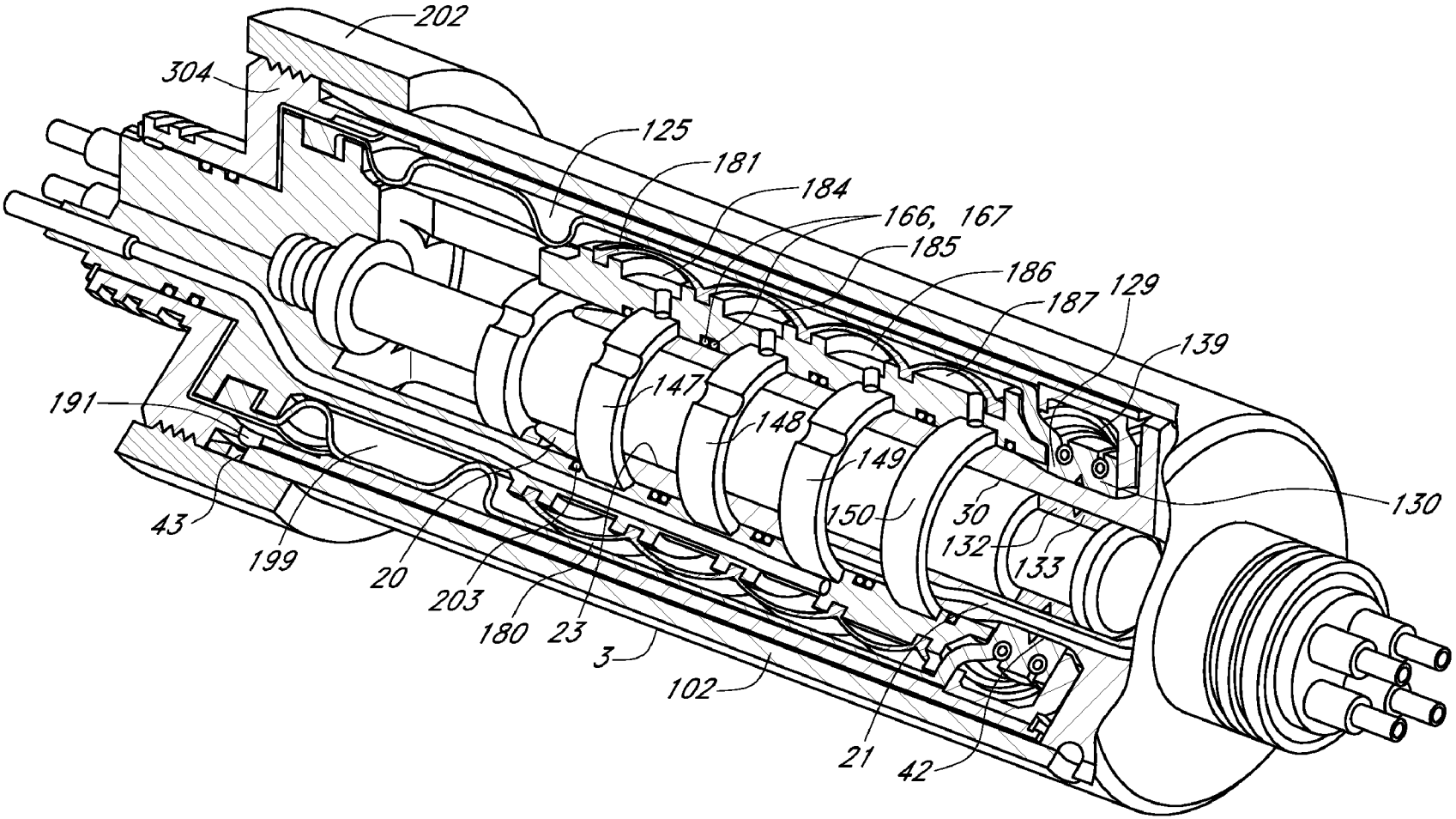
FIG. 10 is a 135 degree axial, partial cross-sectional view of the mated plug and receptacle units.

FIGS. 1 and 10 illustrate the plug and receptacle units in mating engagement. FIG. 10 shows a partial, 135° axial-section through the mated plug and receptacle units of connector 500. As the mating sequence begins, receptacle unit 300 enters the open end of plug front shell 201. As mating proceeds, tapered end 20 of hollow plug pin 15 enters annular opening 143 in the mating face of the receptacle end cap 103, eventually pressing against the interface between receptacle end seals 130 and 133. Continued engagement of the mating halves causes plug pin tapered end 20 to pass sealably into and through the interface, the end seals wiping clean the inside 30 and outside 31 surfaces of plug pin 15 as the pin passes through them. Receptacle end seals 129 and 132 provide a second wiping and sealing of the pin surfaces. Comparing the largest-diameter portion 199 of outer receptacle bladder 125 in FIGS. 5 and 10 it is seen that portion 199 balloons outward when mated due to the amount of oil 190 displaced by incoming plug pin 15.

At the same time, receptacle center rod 136 enters bore 23 of plug pin 15 and cooperates with plug front shell 201 and receptacle shell 301 to further axially align the mating components. As receptacle center rod 136 sealably enters bore 23 of plug pin 15, it forces environmental material, e.g. water in the case of underwater mating, out through passages 24 in base flange 26 of plug contact module 2, the material entering circumferential groove 25 in the flange, and eventually exiting through vent holes 27 in plug front shell 201. At the same time, the outer shell 301 of receptacle unit 300 enters plug front shell 201, also forcing environmental material, e.g. water in the case of underwater mating, out through vent holes 27 in plug front shell 201. The mating sequence continues until alignment-retention tongue or key member 204 of plug shell 201 encounters face 303 of receptacle shell 301. The units are then rotated about the mating axis until tongue 204 finds alignment slot 302 in receptacle shell 301, after which the receptacle is free to enter more deeply into plug bore 203. As the mating proceeds, threads 205 of coupling nut 202 engage mating threads 304 of receptacle shell 301. Coupling-nut 202 is then tightened, drawing plug 200 and receptacle 300 into final mated position. Demating of plug 200 and receptacle 300 takes place in the reverse sequence.

A study of FIG. 10 reveals that each plug/receptacle set of engaged contacts is separated from each other set by at least two elastomeric barriers, and furthermore that each set is separated from the external environment by at least two elastomeric barriers. Each contact set is enclosed in its own sealed oil volume 184, 185, 186, 187 defined by the bulbous elastomeric wall segments 181 of inner receptacle bladder 180, and by seals such as 166,167 and 203 which seal to plug pin 15. These individual sealed volumes are closed off as plug pin 15 nears the fully-mated position. Therefore, they need only to compensate the oil volume contained within them for environmental variations such as temperature and pressure. Once the connector is fully mated, further ventilation to the exterior environment occurs through vents 191 in receptacle shell 301 and vents 43 in plug shell 201.

As learned from the co-pending application Ser. No. 12/943,301 referenced above (Keyless Harsh-Environment Electrical Connector), it is not necessary to keep the plug and receptacle contact modules rotationally aligned to maintain the integrity of the mated electrical circuits. However, in the present embodiment of the connector, plug 200 and receptacle 300 are retained together by a threaded joint between threads 205 of coupling-nut 202 and threads 304 of receptacle shell 301. Because rear shell 206 of plug 200 is free to rotate within plug front shell 201, a keying mechanism is provided to resist or prevent un-screwing of the threaded connection. The cooperation of tongue 204 and slot 302 provides a keying mechanism to resist or prevent rotation of front shell 201 relative to outer shell 301 when the units are fully mated, so that cable torque applied to the terminal end of plug 200 via rear shell 206 does not tend to cause coupling-nut threads 205 to un-screw from receptacle threads 304.

In the connector described above, the receptacle contacts are housed in a pressure-balanced chamber filled with non-conductive oil. During the mating/de-mating sequence the plug probe or pin enters the receptacle contact chamber through an opening that remains sealed before, during, and after mating and de-mating. The plug and receptacle's relative angular position around the mating/de-mating axis is unimportant, and need not be controlled. Furthermore, the plug and receptacle electrical contacts of the mated connector can rotate about the mating axis without degradation of the device or of the connected circuits' quality, which allows the connector to be adapted as described above for use as a rotating joint connector. In the above embodiment, the plug and receptacle units are contained in housings that, once joined, permit their free angular rotation while still supporting axial thrust and/or tensile and bending loads. This allows the connector to be used as a rotary joint (sometimes also called a slip-ring joint).

The construction described above in connection with FIGS. 1 to 10 provides an underwater mateable, multi-circuit electrical connector that also works as an underwater-mateable rotary joint. It is clear that there are many ways in which the electrical connector's plug and receptacle could be housed so as to be used as a rotary joint; the embodiment described herein is simply one of them.

There are many known electrical rotary joint connectors that function in dry environments. There are also some harsh-environment rotary joint connectors now in use for limited applications, such as for down-hole drill-strings; but they are not intended for general use, or for mating while completely submerged in a hostile environment. The keyless, rotary joint electrical connector described above provides scope and flexibility for addressing many possible different applications, and is capable of mating while completely submerged in a hostile environment. Potential fields of application for this rotary joint technology include underwater cable winches, moored or tethered system cables, towed-system cables, drill string connections, ROV vehicle umbilicals, seafloor cable pay-out packs, and other uses not yet envisioned.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

I claim:

1. A submersible or harsh environment multi-circuit connector, comprising:

first and second releasably mateable connector units movable along a mating/de-mating axis between mated and unmated conditions, the first and second connector units having respective first and second contact modules, each contact module having a plurality of contacts configured for keyless mating engagement with corresponding contacts of the other connector unit when the units are fully mated, the engagement being independent of relative rotational alignment of the contact modules about the mating/de-mating axis;

at least one of the connector units having a fluid-filled contact chamber in which the corresponding contact module is located and a sealing mechanism at the forward end of the chamber which seals the chamber when the units are unmated and forms a seal with the other connector unit both during and after mating of the units; and the first connector unit having a front shell, a rear shell, and a rotatable connection between the front and rear shells configured to permit relative rotation between the shells about the mating/de-mating axis, the first contact module being secured to one of the shells, wherein the first and second contact modules are relatively rotatable about the mating/de-mating axis in the mated condition of the units while maintaining mated engagement between corresponding contacts of the first and second contact modules.

2. The connector of claim 1, wherein one of the connector units comprises a plug unit with a contact module having a pin with an outer surface carrying a plurality of axially spaced, annular contacts of gradually decreasing diameter towards a forward end of the pin, and the other connector unit comprises a receptacle unit releasably mateable with the plug unit and including said fluid-filled contact chamber, the contact module of said other connector unit being located in said contact chamber and having a bore configured for engagement over the pin, the bore having a plurality of axially spaced, annular contacts of gradually increasing diameter towards a forward end of the receptacle unit, the contacts being configured for mating engagement with corresponding annular contacts of the plug contact module when the plug and receptacle units are mated, the sealing mechanism which seals the chamber when the units are unmated being configured to form a seal with the plug module pin both during and after mating of the units.

3. The connector of claim 2, wherein the plug unit comprises the first connector unit.

4. The connector of claim 2, wherein the plug pin is hollow and has a bore extending inwardly from a forward end of the pin, and the sealing mechanism comprises an annular end seal at the forward end of the chamber and a center rod extending through the chamber which has a forward end portion in sealing engagement with the annular end seal in the unmated condition of the units, the center rod being configured for extending into the bore of the hollow plug pin in the mated condition of the units.

5. The connector of claim 1, wherein the rotatable connection includes at least one thrust bearing assembly.

6. The connector of claim 1, wherein the rotatable connection comprises an annular groove on one of the shells and an annular flange on the other shell which is rotatably engaged in said annular groove.

7. The connector of claim 6, wherein the annular groove comprises an inwardly directed annular shoulder in said front shell and a back-up ring spaced from said shoulder and releasably retained in said through bore to define said annular groove.

8. The connector of claim 6, wherein the annular groove has opposing first and second end faces, and the rotatable connection further comprises a first annular thrust bearing located between the first end face of the groove and the annular flange and a second annular thrust bearing located between the second end face of the groove and the annular flange.

9. The connector of claim 8, wherein each annular thrust bearing has an annular bearing race and a plurality of circumferentially spaced rotatable bearings protruding from opposite sides of the bearing race and axially captured between a respective end face of the groove and an opposing face of the annular flange.

10. The connector of claim 9, wherein at least one of the bearing race and bearings is of non-metallic material.

11. The connector of claim 10, wherein the bearing race and bearings are of different non-metallic materials.

12. The connector of claim 11, wherein the bearings are of ceramic material.

13. The connector of claim 12, wherein the bearing races are of composite plastic material.

14. The connector of claim 8, further comprising seals between opposing faces of said front and rear shells configured to seal said annular groove to form a sealed chamber around said annular flange and thrust bearings.

15. The connector of claim 14, wherein said sealed chamber is packed with packing material.

16. The connector of claim 15, wherein the packing material comprises a grease or gel material.

17. The connector of claim 1, wherein the rear shell is configured for securing to a cable and the first contact module is secured to the rear shell to rotate relative to the front shell in response to torque or twist in an attached cable.

18. The connector of claim 17, further comprising a coupling nut configured for releasably securing the front shell to the second connector unit in the mated condition of the units, whereby the first contact module is rotatable relative to the second connector unit in the mated condition of the units.

19. The connector of claim 18, further comprising a key mechanism between the front shell and the second connector unit in the mated condition of the units which resists rotation of the front shell relative to the second connector unit.

20. The connector of claim 19, wherein the second connector unit has an outer shell and the second contact module is mounted in the outer shell, the coupling nut is rotatably mounted at the forward end of the front shell and the outer shell of the second connector unit has a rear portion which is externally threaded for releasable threaded engagement with the coupling nut, the key mechanism comprising a tongue extending from the forward end of the front shell into the coupling nut and a slot in the rear portion of the outer shell configured to receive the tongue in the mated condition of the units.

21. The connector of claim 17, wherein the first connector unit comprises a plug unit and the forward shell is hollow with an open front end, and the first contact module comprises a plug contact pin extending from the rear shell into the front shell, the contacts on the plug contact pin comprising spaced annular contacts of decreasing diameter towards a forward end of the pin.

22. The connector of claim 21, wherein the second connector unit comprises a receptacle unit having an outer shell containing said fluid-filled contact chamber the second contact module comprising a receptacle contact module which has a plurality of axially spaced, annular contacts of gradually increasing diameter towards the forward end of the receptacle unit configured for mating engagement with corresponding annular contacts of the plug contact module when the units are mated, and the sealing mechanism at the forward end of the chamber seals the chamber when the units are unmated and forms a seal with the plug contact pin both during and after mating of the units.

23. The connector of claim 1, wherein the front shell is hollow and has an open forward end and a rear end portion, the rear shell is rotatably mounted in the rear end portion of the front shell, and the first contact module is secured to the rear shell for rotation with the rear shell relative to the front shell.

24. A submersible or harsh environment connector, comprising:

a plug unit having a plug contact module comprising a pin with an outer surface carrying a plurality of axially spaced, annular contacts of gradually decreasing diameter towards a forward end of the pin;

a receptacle unit configured for releasable mating engagement with the plug unit and having a fluid-filled contact chamber, a receptacle contact module in the contact chamber which has a contact bore having a plurality of axially spaced, annular contacts of gradually increasing diameter towards a forward end of the receptacle unit and configured for mating contact with corresponding contacts of the plug module in the mated condition of the units, and a sealing mechanism at a forward end of the chamber which seals the chamber when the units are unmated and forms a seal with the plug unit pin both during and after mating of the units;

wherein a first one of the units has first and second relatively rotatable front and rear shells, and the contact module of said one unit is secured to one of the shells, thereby providing a rotary joint.

25. The connector of claim 24, wherein said first unit comprises the plug unit.

26. The connector of claim 25, wherein the receptacle unit further comprises a center rod extending through the contact bore, the rod having a forward end, and the sealing mechanism includes an annular front seal member which seals against forward end of the center rod in the unmated condition of the units and seals against the plug pin in the mated condition of the units.

27. The connector of claim 26, wherein the plug pin is hollow and has an inner bore configured to receive the center rod in the mated condition of the units.

28. The connector of claim 27, wherein the forward end of the center rod has an outer annular seal which forms a seal with the annular front seal in the unmated condition of the units, the annular end seal and opposing outer seal on the forward end of the center rod seal being configured to seal against opposing outer and inner faces of the hollow plug pin in the mated condition of the units.

29. The connector of claim 24, further comprising a rotatable connection between the front and rear shells, the rotatable connection including at least one thrust bearing assembly.

30. The connector of claim 29, wherein the rotatable connection comprises an annular groove in one of the shells and an annular flange on the other shell which is rotatably engaged in said annular groove to provide said rotatable connection.

31. The connector of claim 30, wherein the rotatable connection further comprises first and second annular thrust bearings located in said groove on opposite sides of said annular flange.

32. The connector of claim 25, wherein the rear shell is configured for securing to a cable and the plug contact module is secured to the rear shell to rotate relative to the front shell in response to torque or twist in an attached cable.

33. The connector of claim 32, further comprising a coupling nut configured for releasably securing the front shell to the receptacle unit in the mated condition of the units, whereby the plug contact module is rotatable relative to the receptacle contact module in the mated condition of the units while maintaining contact between the opposing annular plug and receptacle contacts.

34. The connector of claim 33, wherein the front shell has a key member configured to engage the receptacle unit in the mated condition of the units and resist rotation of the front shell relative to the receptacle unit.

35. The connector of claim 34, wherein the receptacle unit has an outer shell and the receptacle contact module is mounted in the outer shell, the coupling nut is rotatably mounted at the forward end of the front shell and the outer shell of the receptacle unit has a rear portion which is externally threaded for releasable threaded engagement with the coupling nut, the key member comprising a tongue extending from the forward end of the front shell into the coupling nut and the rear portion of the outer shell having a slot configured to receive the tongue in the mated condition of the units.

* * * * *